US010772385B2

(12) United States Patent
Jiang

(10) Patent No.: US 10,772,385 B2
(45) Date of Patent: Sep. 15, 2020

(54) SHOELACE FOLDING AND RELEASING DEVICE

(71) Applicant: SHENZHEN YOW TECHNOLOGY CO., LTD., Guangdong (CN)

(72) Inventor: Xiaohua Jiang, Guangdong (CN)

(73) Assignee: SHENZHEN YOW TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/344,454

(22) PCT Filed: Mar. 1, 2017

(86) PCT No.: PCT/CN2017/075342
§ 371 (c)(1),
(2) Date: Apr. 24, 2019

(87) PCT Pub. No.: WO2018/137274
PCT Pub. Date: Aug. 2, 2018

(65) Prior Publication Data

US 2019/0320763 A1 Oct. 24, 2019

(30) Foreign Application Priority Data

Jan. 24, 2017 (CN) ..... 2017 1 0055543

(51) Int. Cl.
*A43C 11/16* (2006.01)
*B65H 75/44* (2006.01)

(52) U.S. Cl.
CPC ..... *A43C 11/165* (2013.01); *B65H 75/4431* (2013.01)

(58) Field of Classification Search
CPC ..... A43C 11/165; A43C 11/16; A43C 11/00; A43C 11/004; B65H 75/4431; B65D 2701/35; B65D 2701/537; Y10T 24/2183
See application file for complete search history.

(56) References Cited

U.S. PATENT DOCUMENTS 9,486,039 B2 * 11/2016 Ha ..... A43C 11/24
9,635,906 B2 * 5/2017 Midorikawa ..... A43C 11/165
(Continued)

FOREIGN PATENT DOCUMENTS

CN 2613167 Y 4/2004
CN 201718602 U 1/2011
(Continued)

*Primary Examiner* — Robert Sandy
*Assistant Examiner* — Rowland Do
(74) *Attorney, Agent, or Firm* — Berggren LLP

(57) ABSTRACT

Disclosed is a shoelace folding and releasing device, comprising: a thread reel used for winding thread, a knob device in transmission connection with the thread reel, and a position limiting device and arresting disk arranged between the thread reel and the knob device. After the knob device is pressed, both the thread reel and the arresting disk are locked with the knob device. The arresting disk restricts the clockwise or counterclockwise rotation of the knob device, and the knob device drives the thread reel to rotate so as to tighten a shoelace. When the knob device is pulled out, both the thread reel and the arresting disk are unlocked from the knob device, and the thread reel releases the shoelace, and at the same time, the position limiting device restricts the separation of the knob device.

9 Claims, 11 Drawing Sheets

(56) References Cited

U.S. PATENT DOCUMENTS

| | | | | |
|---|---|---|---|---|
| 9,706,814 | B2 * | 7/2017 | Converse | A61F 5/028 |
| 9,717,305 | B2 * | 8/2017 | Midorikawa | A43C 11/165 |
| 2010/0251524 | A1 * | 10/2010 | Chen | A43C 7/00 24/713.2 |
| 2013/0025100 | A1 * | 1/2013 | Ha | A43C 11/165 24/712.9 |
| 2013/0092780 | A1 * | 4/2013 | Soderberg | A43C 11/165 242/396.4 |
| 2014/0097283 | A1 * | 4/2014 | So | A44B 99/00 242/404 |
| 2014/0359981 | A1 * | 12/2014 | Cotterman | A43C 11/20 24/712.9 |
| 2016/0198801 | A1 | 7/2016 | Kim | |
| 2016/0213099 | A1 * | 7/2016 | Ha | A43C 11/165 |
| 2018/0132567 | A1 * | 5/2018 | Lee | A43C 7/00 |

FOREIGN PATENT DOCUMENTS

| | | | |
|---|---|---|---|
| CN | 103153112 | A | 6/2013 |
| CN | 103224169 | A | 7/2013 |
| CN | 103619208 | A | 3/2014 |
| CN | 203492894 | U | 3/2014 |
| CN | 105982392 | A | 10/2016 |
| CN | 205709248 | U | 11/2016 |
| CN | 206413842 | U | 8/2017 |
| EP | 0132744 | A1 | 2/1985 |
| KR | 101025134 | B1 | 3/2011 |
| KR | 101438572 | B1 | 9/2014 |
| TW | 201609013 | A | 3/2016 |
| WO | 2016099070 | A1 | 6/2016 |

* cited by examiner

SHOELACE FOLDING AND RELEASING DEVICE

PRIORITY

This application is a U.S. national application of the international application number PCT/CN2017/075342 filed on 1 Mar. 2017, which claims priority of Chinese patent application CN201710055543.7 filed on Jan. 24, 2017, the contents of all of which are incorporated herein by reference.

CROSS-REFERENCE TO RELATED APPLICATIONS

The present disclosure claims priority to Chinese Patent Application No. CN201710055543.7, filed with the Chinese Patent Office on Jan. 24, 2017, entitled "Shoelace Folding and Releasing Device", which is incorporated herein by reference in its entirety.

TECHNICAL FIELD

The present disclosure relates to the field of daily necessities, and more specifically to a shoelace tightening (folding) and releasing device.

BACKGROUND ART

There are countless uses for ropes, and specifically, ropes are used for from the fixing of materials in a building to the fabrication of wick as well as for climbing down the cliff with a method of descending along a rope or setting up a net for hunting. About half or more of the ropes produced in the world are used in the maritime industry and fishing industry. Other ropes also have found a wide range of applications, and ropes, including from clotheslines and shoelaces for ordinary households to load-carrying cables for large-scale drilling tasks, can be seen everywhere around us.

The rope is made of fibers joined into a certain length after being reinforced by means of twisting or braiding or other method. It has good tensile strength but has no compressive strength and may be used as a tool for connection and dragging. Openings of today's backpacks or shoes are usually closed and connected by using ropes. When the prior ropes are to be used for connection and fixation, a user needs to use both hands to pull a plurality of ropes tight and then tie a knot for fixation, thereby causing inconvenience to the user. In particular, people should perform repeated operations of tying and untying the shoelaces every time they wear shoes and take off shoes, which is a waste of time.

In particular, the prior winding device has a relatively small internal space, and usually requires a specially-made relatively small shoelace, whereby the cost is increased, and its use range is limited to a certain extent.

SUMMARY

In view of the above, the present disclosure solves the technical problem of overcoming the deficiencies of the prior art, and provides a shoelace tightening and releasing device, comprising:

a thread reel configured to allow a thread to wind thereon, a knob device in transmission connection with the thread reel, and a position-limiting device and an arresting disk arranged between the thread reel and the knob device;

wherein a first master linkage component is disposed on a side of the knob device that faces the thread reel; and a first slave linkage component meshed with the first master linkage component is disposed on a side of the thread reel that faces the knob device;

the arresting disk is provided with a master arresting component; and the knob device is provided with a slave arresting component that is meshed with the master arresting component;

the position-limiting device is provided with a master position-limiting component; and the knob device is provided with a slave position-limiting component that is engaged with the master position-limiting component;

after the knob device is pressed, both the thread reel and the arresting disk are locked relative to the knob device, the arresting disk restricts a clockwise or counterclockwise rotation of the knob device, and the knob device drives the thread reel to rotate so as to tighten the shoelace;

when the knob device is pulled up, both the thread reel and the arresting disk are unlocked from the knob device, and the thread reel releases the shoelace, and at the same time, the position-limiting device restricts the detachment of the knob device.

In some embodiments, the thread reel comprises a winding spindle, a top disk, and a bottom disk arranged at a bottom of the winding spindle; the bottom disk is provided with a bottom through hole allowing the shoelace to pass therethrough; the winding spindle is provided with a spindle hole communicating with the bottom through hole; and the first slave linkage component is disposed at an end of the winding spindle that faces the position-limiting device.

In some embodiments, the position-limiting device is provided with a receiving cavity for receiving the thread reel; and the receiving cavity is provided with a position-limiting hole allowing the winding spindle to pass therethrough.

In some embodiments, the master position-limiting component is provided with a position-limiting hole; the master position-limiting component is disposed on an inner peripheral side of the position-limiting hole; and the slave position-limiting component is a lug disposed on an outer peripheral side of the first master linkage component.

In some embodiments, the slave arresting component is a ratchet disposed protrudingly on a side of the knob device that faces the arresting disk; the master arresting component is a pawl; the arresting disk is provided with an arresting hole allowing the first master linkage component to pass therethrough; and after the arresting disk is locked relative to the knob device, the pawl is meshed with the ratchet.

In some embodiments, the pawl is a pawl provided with a V-shaped opening.

In some embodiments, a base sleeved on the bottom of the position-limiting component is further included; the base is provided with a first threading hole; and a second threading hole is formed in a side of the bottom of the position-limiting device.

In some embodiments, a position-limiting buckle is disposed on an inner peripheral side of the base; and a bump interlocked with the position-limiting buckle is disposed on an outer peripheral side of the position-limiting device.

In some embodiments, an engagement buckle configured to restrict the detachment of the arresting disk is further disposed protrudingly on a peripheral side of the position-limiting hole; and an outer diameter of the arresting disk is not less than an inner diameter of the position-limiting device.

In some embodiments, a number of claws disposed in a triangular shape are provided on a side of the first master linkage component that faces the arresting disk.

The shoelace tightening and releasing device according to the present disclosure has the following beneficial effects:

Compared with the prior art, the shoelace tightening and releasing device according to the present disclosure comprises: a thread reel configured to allow a thread to wind thereon, a knob device in transmission connection with the thread reel, and a position-limiting device and an arresting disk arranged between the thread reel and the knob device; after the knob device is pressed, a slave position-limiting component on a first master linkage component of the knob device is staggered relative to a master position-limiting component on the position-limiting device, and at the same time, both the thread reel and the arresting disk are locked relative to the knob device, and the arresting disk restricts the clockwise or counterclockwise rotation of the knob device so that the rotating device can be rotated only clockwise or counterclockwise, and of course, the thread reel locked relative thereto rotates in a direction coinciding with the rotating direction of the rotating device and cannot rotate in the reverse direction. The knob device drives the thread reel to rotate so as to tighten the shoelace.

When the knob device is pulled up, the slave position-limiting component on the first master linkage component of the knob device is staggered relative to the master position-limiting component on the position-limiting device again, both the thread reel and the arresting disk are unlocked from the knob device, the thread reel releases the shoelace, and at the same time the position-limiting device restricts the detachment of the knob device.

Further, the shoelace is threaded through the bottom through hole of the bottom disk, comes out from the spindle hole and is fixed to the thread reel.

Further, the position-limiting device is provided with a receiving cavity for receiving the thread reel; and the receiving cavity is provided with a position-limiting hole allowing the winding spindle to pass therethrough. With the receiving cavity, the space for receiving the shoelaces inside the shoelace tightening and releasing device is enlarged, various types and various styles of shoelaces with different thicknesses can be used, the use range of the shoelace tightening and releasing device is extended, the specific limitation of the thickness of the shoelaces by the prior shoelace tightening and releasing devices is avoided, and the market for the shoelace tightening and releasing device is effectively expanded.

Further, the master position-limiting component is disposed on an outer peripheral side of the first master linkage component, and such arrangement allows a force to be applied more uniformly when the rotating device is pressed or pulled out. The specific process may be explained as follows: each of the master position-limiting component of the knob device and the slave position-limiting component of the position-limiting device can be disposed as a lug structure, the slave position-limiting component is moved downward over the master position-limiting component when the knob device is pressed, and the slave position-limiting component is moved upward over the master position-limiting component when the knob device is pulled up.

Further, a base sleeved on the bottom of the position-limiting device is further included. A position-limiting buckle is disposed on an inner peripheral side of the base; and a bump interlocked with the position-limiting buckle is disposed on an outer peripheral side of the position-limiting device.

The position-limiting buckle of the base cooperates with the bump, so that the thread reel is not easily detached from the base under the action of an external force after the thread reel is assembled with the base.

Further, a ratchet is disposed protrudingly on a side of the rotating component that faces the arresting disk, the arresting disk is received into an inner peripheral side of the ratchet, and a pawl of the arresting disk is meshed with the slave arresting component.

Further, an engagement buckle configured to restrict the detachment of the arresting disk is disposed protrudingly on a peripheral side of the position-limiting hole; and an outer diameter of the arresting disk is not less than an inner diameter of the position-limiting device, and the arresting disk is stuck in the position-limiting device and thus is not likely to shake.

Further, a number of claws disposed in a triangular shape are provided on a side of the first master linkage component that faces the arresting disk.

The first master linkage component with such structure can not only better achieve the transmission of a force, but also avoid the problem of unstable engagement of the thread reel due to disengagement of the thread reel.

The user of the device can achieve the retraction or release of the shoelace by only pressing the knob device or pulling out the knob device. There is no need to perform a process of pulling ropes tight and then tying a knot for fixation to connect the ropes and untying the knots one by one to loosen the ropes, whereby time is saved, and great convenience is brought to the user.

BRIEF DESCRIPTION OF DRAWINGS

It should be understood that the drawings below are merely illustrative of some embodiments of the present disclosure, and therefore should not be considered as limiting its scope. It would be understood by those of ordinary skill in the art that other relevant drawings could also be obtained from these drawings without inventive effort.

Figure 1:
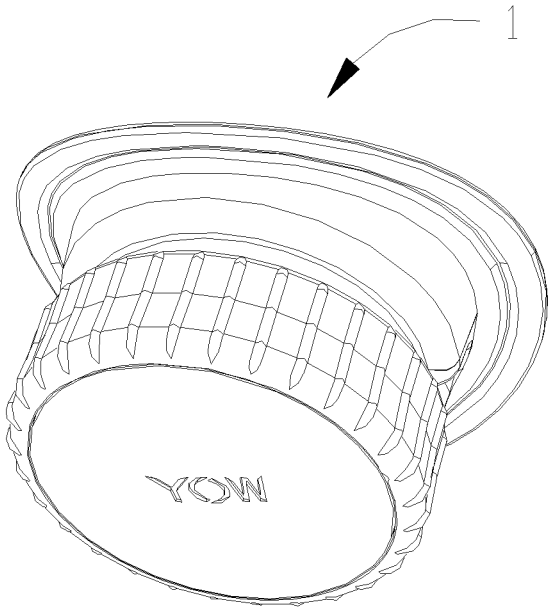
FIG. 1 is a schematic overall view of a shoelace tightening and releasing device of the present disclosure.

Reference Numerals:

| Name | Reference Numeral |
|---|---|
| Shoelace Tightening and Releasing Device | 1 |
| Thread Reel | 11 |
| Winding Spindle | 111 |
| Spindle Hole | 1111 |
| First Slave Linkage Component | 1112 |
| Top Disk | 112 |
| Bottom Disk | 113 |
| Bottom Through Hole | 1131 |
| Knob Device | 12 |
| First Master Linkage Component | 121 |
| Slave Arresting Component | 122 |
| Slave Position-limiting Component | 123 |
| Position-limiting Device | 13 |
| Master Position-limiting Component | 131 |
| Receiving Cavity | 132 |
| Position-limiting Hole | 1321 |
| Bump | 133 |
| Engagement Buckle | 134 |
| Second Threading Hole | 135 |
| Arresting Disk | 14 |
| Master Arresting Component | 141 |
| Arresting Hole | 142 |
| Pawl | 143 |
| Base | 15 |
| First Threading Hole | 151 |
| Position-limiting Buckle | 152 |

DETAILED DESCRIPTION OF EMBODIMENTS

Embodiments of the present disclosure will be described in detail below, and examples of the embodiments are illustrated in the accompanying drawings, throughout which the same or similar reference numerals denote the same or similar elements or elements having the same or similar functions. The embodiments described below with reference to the accompanying drawings are exemplary, are intended to explain the present disclosure, and are not to be construed as limiting the present disclosure.

In the description of the present disclosure, it should be understood that orientation or positional relationships indicated by the terms such as "length", "width", "up", "down", "front", "rear", "left", "right", "vertical", "horizontal", "top", "bottom", "inside", and "outside" are the orientation or positional relationships shown based on the accompanying drawings, and these terms are intended only to facilitate the description of the present disclosure and simplify the description, but not intended to indicate or imply that the referred devices or elements must be in a particular orientation or constructed or operated in the particular orientation, and therefore should not be construed as limiting the present disclosure.

In addition, the terms "first" and "second" are used for descriptive purposes only, and should not be understood as indication or implication of relative importance or implicit indication of the number of technical features indicated. Thus, a feature defined with the term "first" or "second" may include such one or more features either explicitly or implicitly. In the description of the present disclosure, the phrase "a plurality" means two or more unless expressly and specifically defined otherwise.

In the present disclosure, the terms "mount", "couple", "connect", "fix", and the like should be understood broadly unless otherwise expressly specified or defined. For example, connection may be fixed connection or detachable connection or integral connection, may be mechanical connection or electric connection, or may be direct coupling or indirect coupling via an intermediate medium, or internal communication between two elements or mutual interaction relationship between two elements. The specific meanings of the above-mentioned terms in the present disclosure could be understood by those of ordinary skill in the art according to specific situations.

Embodiment 1

Figure 2:
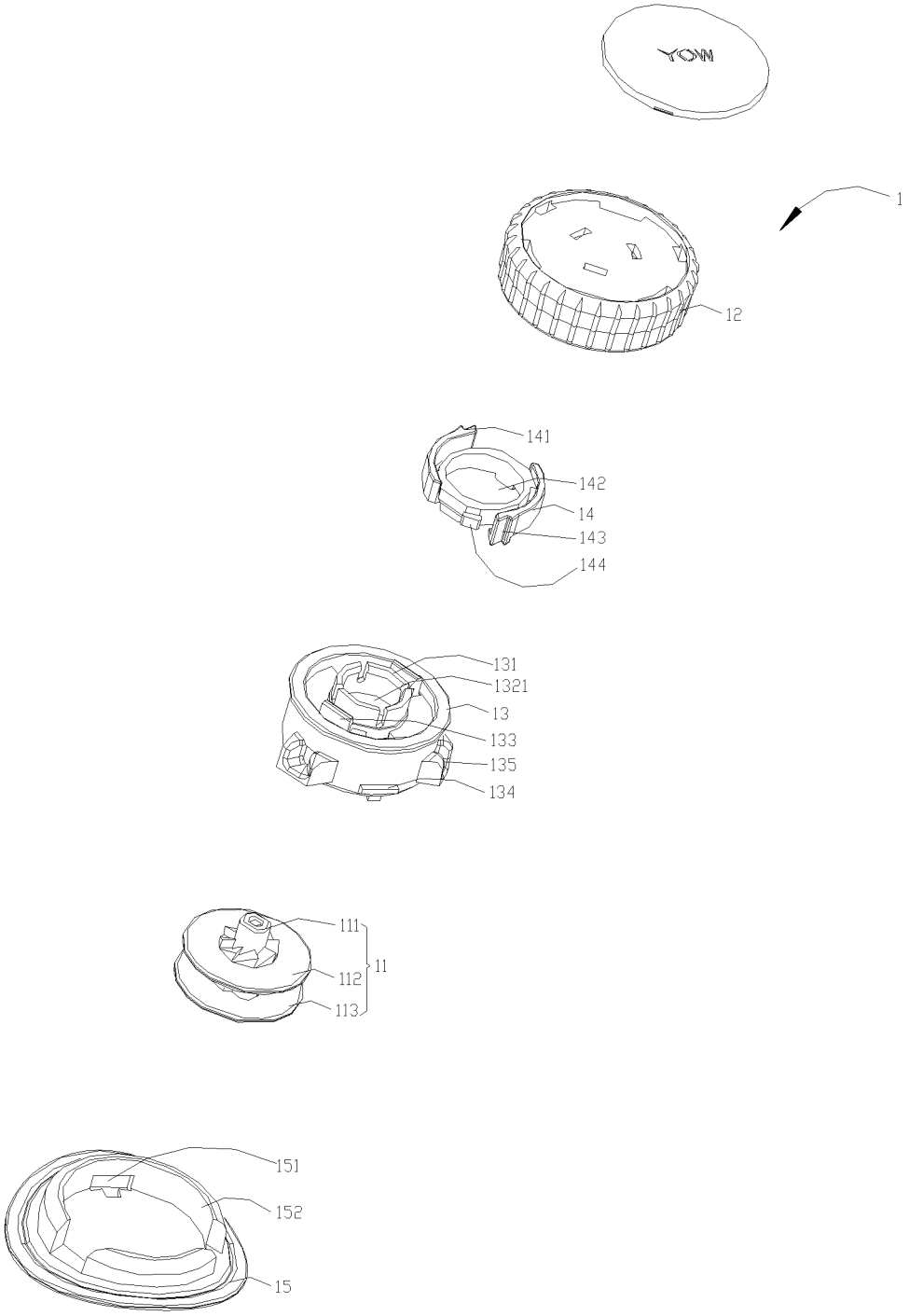
FIG. 2 is a schematic structural view of a shoelace tightening and releasing device of the present disclosure.
Figure 3:
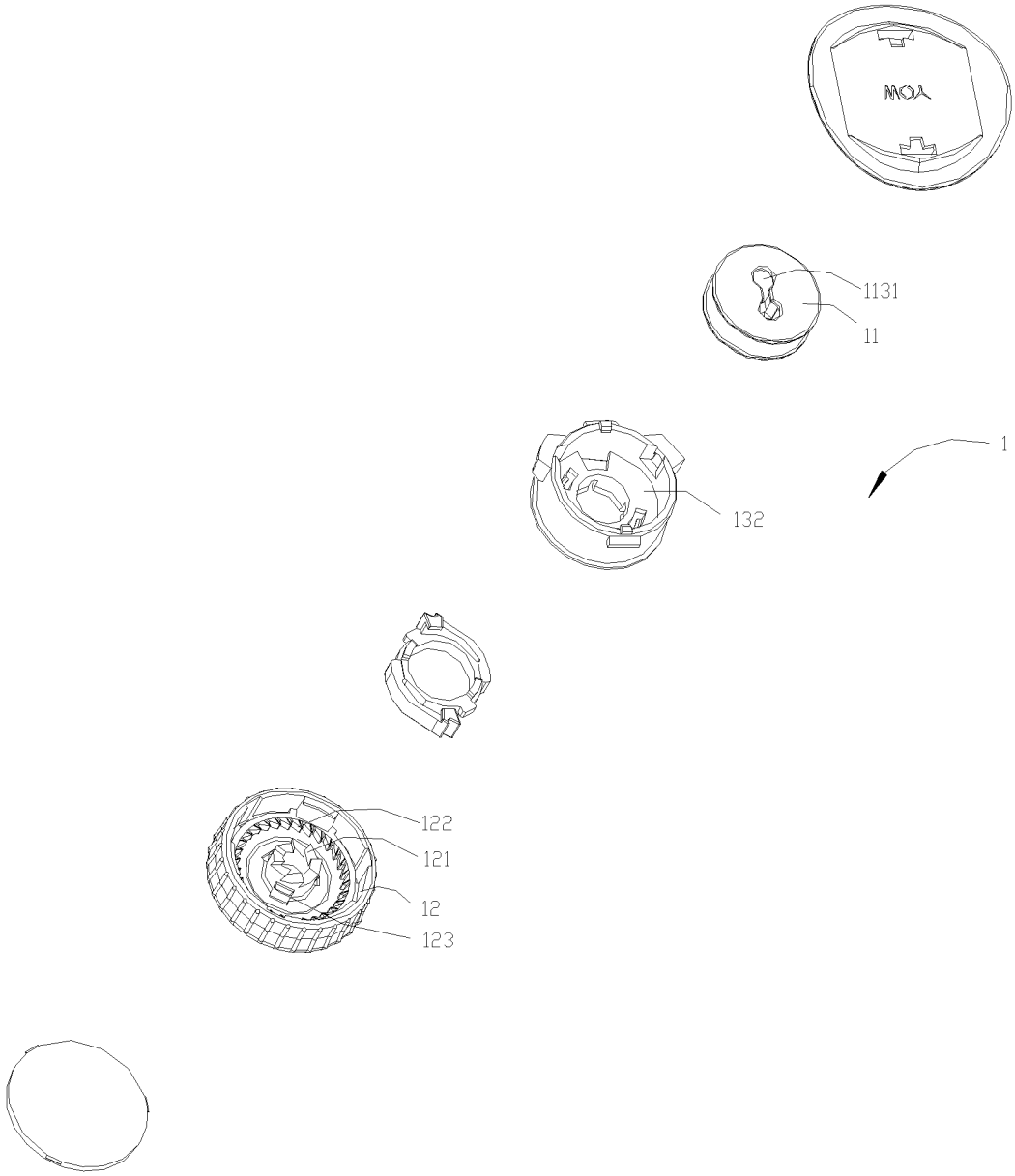
FIG. 3 is a schematic structural view of a shoelace tightening and releasing device of the present disclosure.
Figure 4:
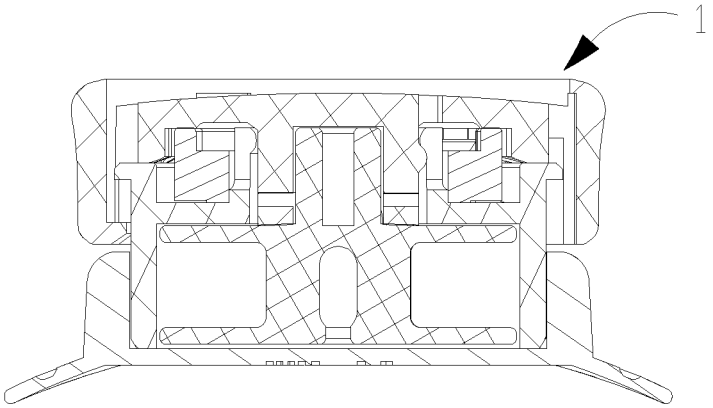
FIG. 4 is a schematic structural view of the shoelace tightening and releasing device of the present disclosure when a rotating device is pressed.
Figure 5:
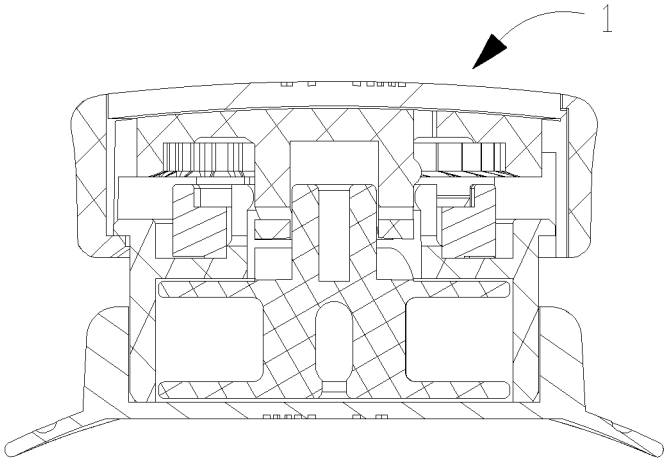
FIG. 5 is a schematic structural view of the shoelace tightening and releasing device of the present disclosure when the rotating device is pulled up.
Figure 6:
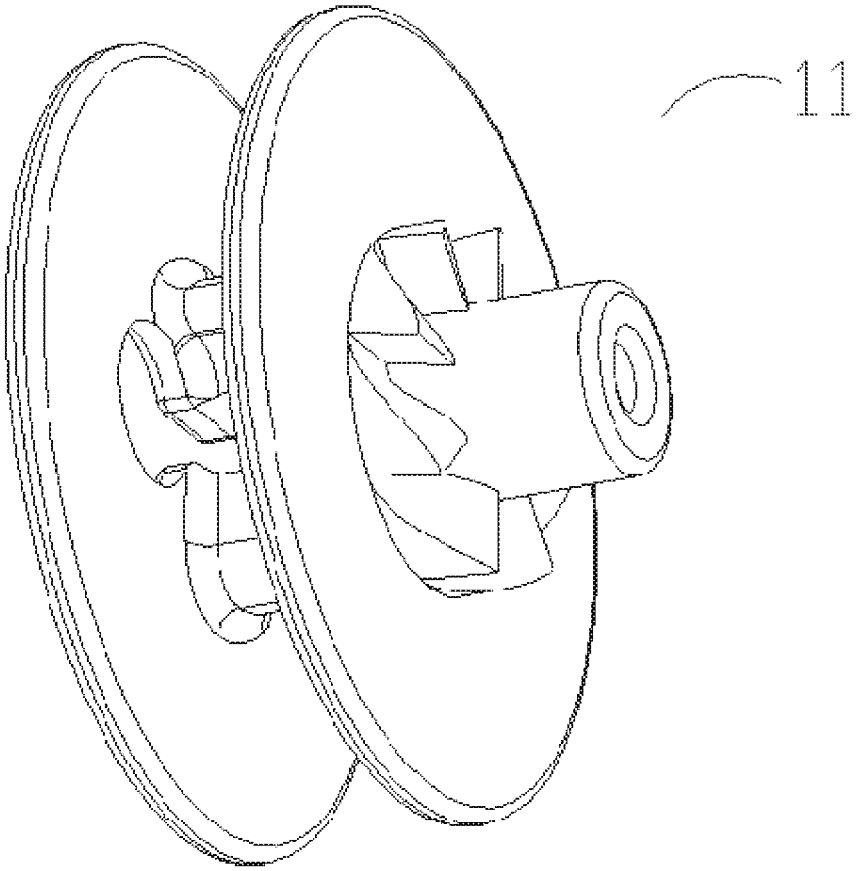
FIG. 6 is a schematic structural view of a thread reel in the shoelace tightening and releasing device of the present disclosure.
Figure 7:
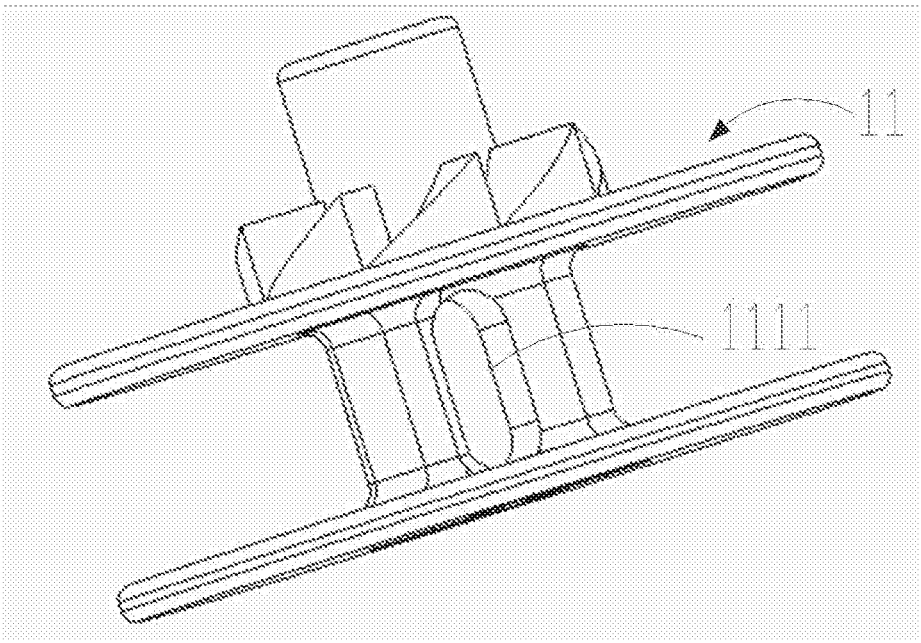
FIG. 7 is a schematic structural view of a thread reel in the shoelace tightening and releasing device of the present disclosure.
Figure 8:
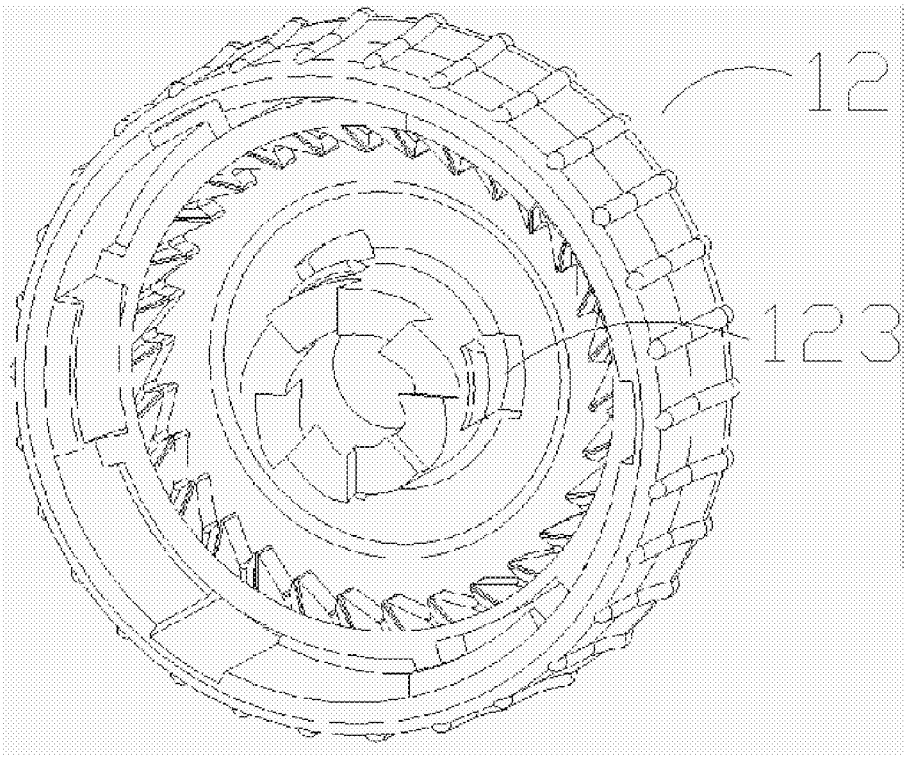
FIG. 8 is a schematic structural view of a rotating device in the shoelace tightening and releasing device of the present disclosure.
Figure 9:
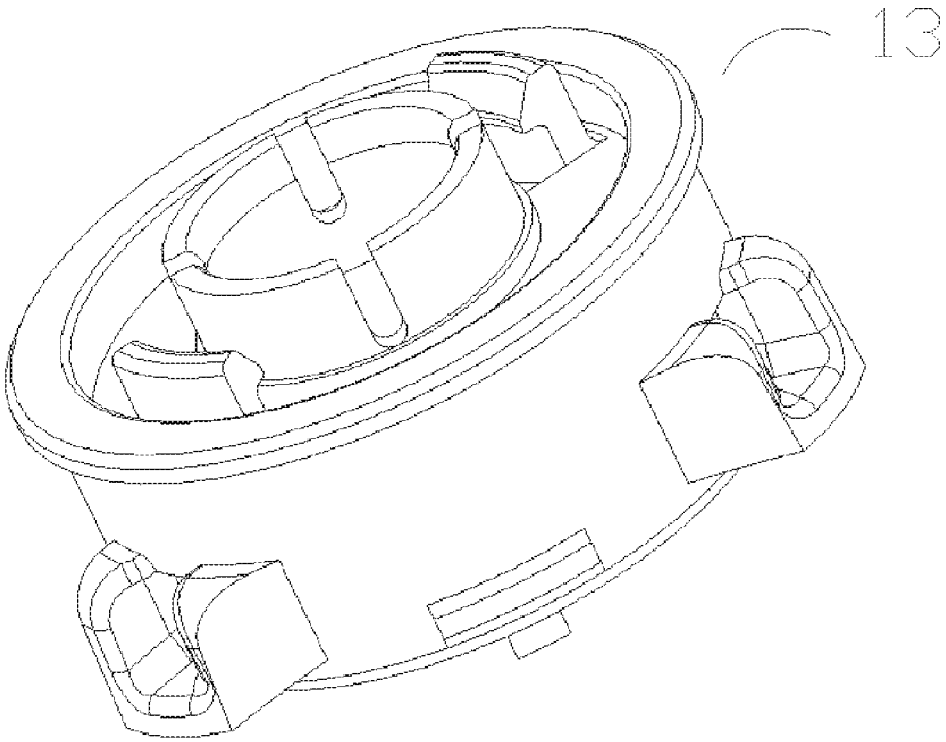
FIG. 9 is a schematic structural view of a position-limiting device in the shoelace tightening and releasing device of the present disclosure.
Figure 10:
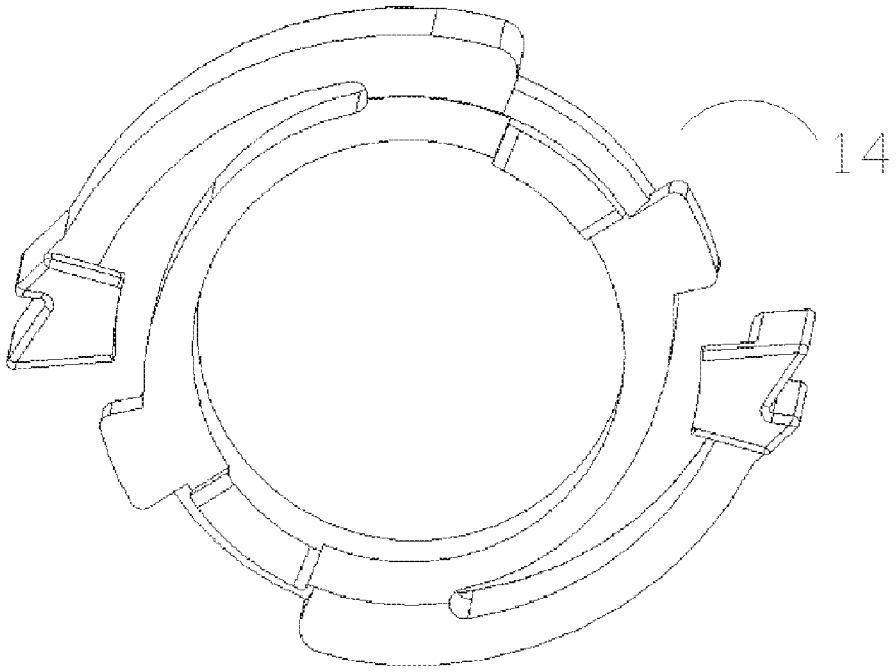
FIG. 10 is a schematic structural view of an arresting disk in the shoelace tightening and releasing device of the present disclosure.
Figure 11:
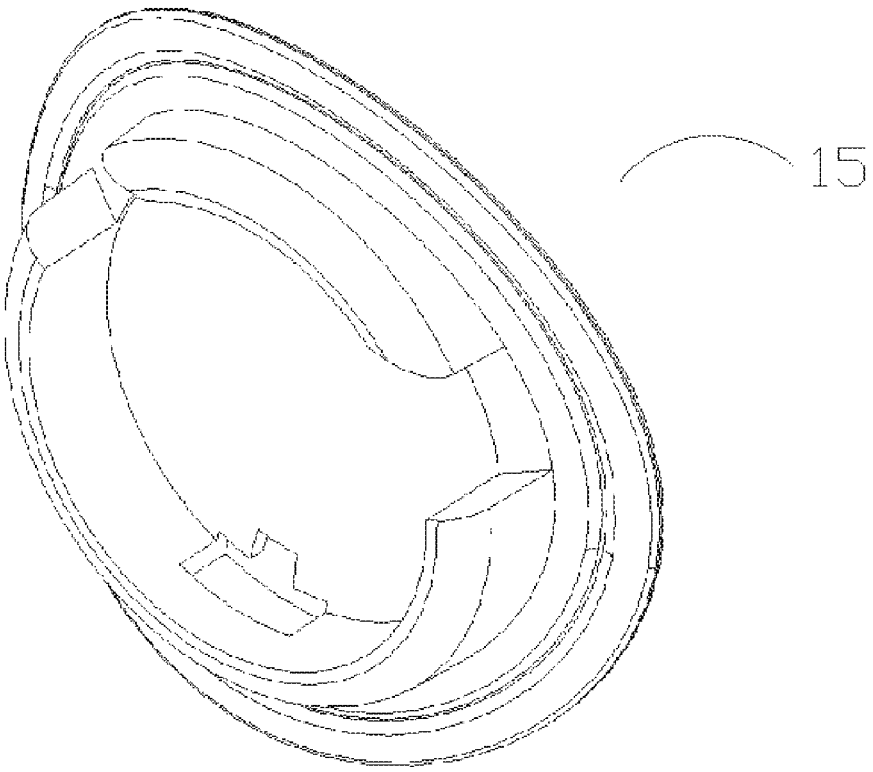
FIG. 11 is a schematic structural view of a base in the shoelace tightening and releasing device of the present disclosure.
Figure 12:
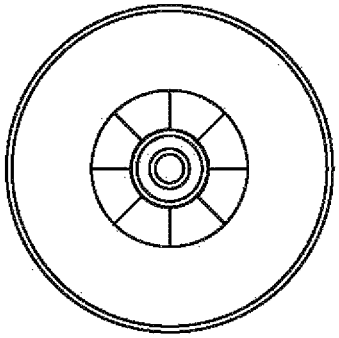
FIG. 12 is a top view of a thread reel in the shoelace tightening and releasing device of the present disclosure.
Figure 13:
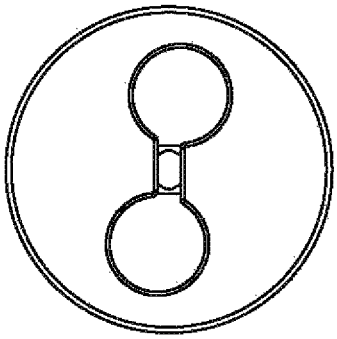
FIG. 13 is a bottom view of the thread reel in the shoelace tightening and releasing device of the present disclosure.
Figure 14:
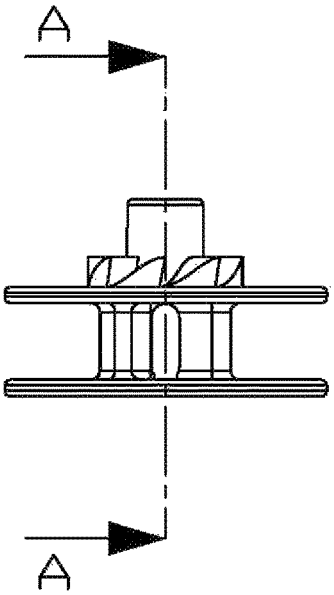
FIG. 14 is a side view of the thread reel in the shoelace tightening and releasing device of the present disclosure.
Figure 15:
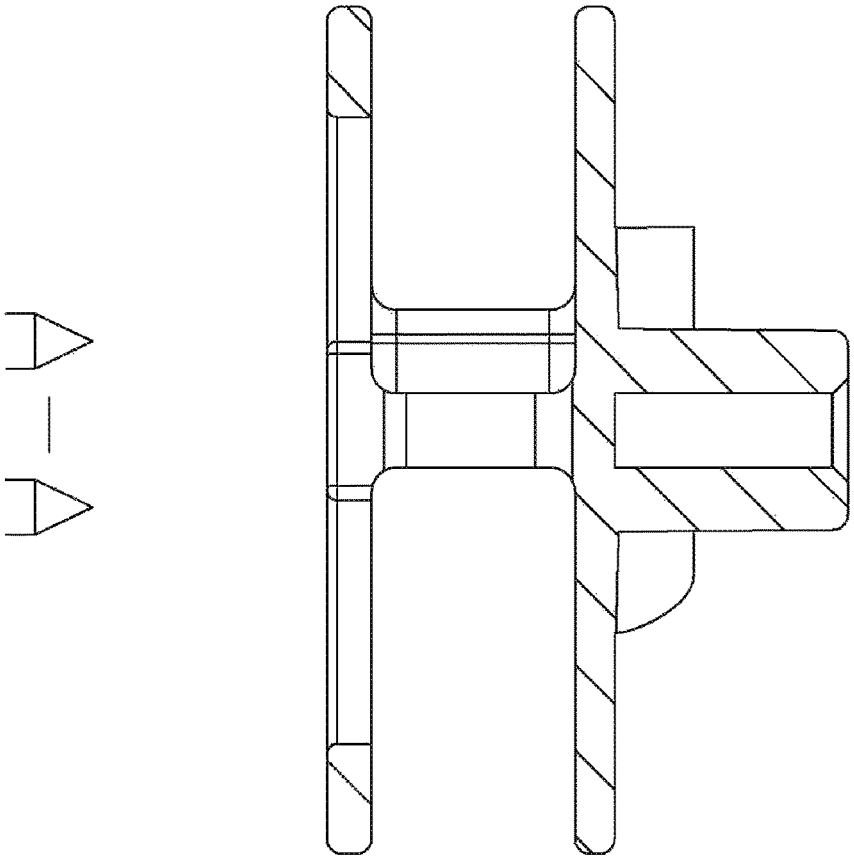
FIG. 15 is a sectional view of the thread reel in the shoelace tightening and releasing device of the present disclosure taken along line A-A in FIG. 14.
Figure 16:
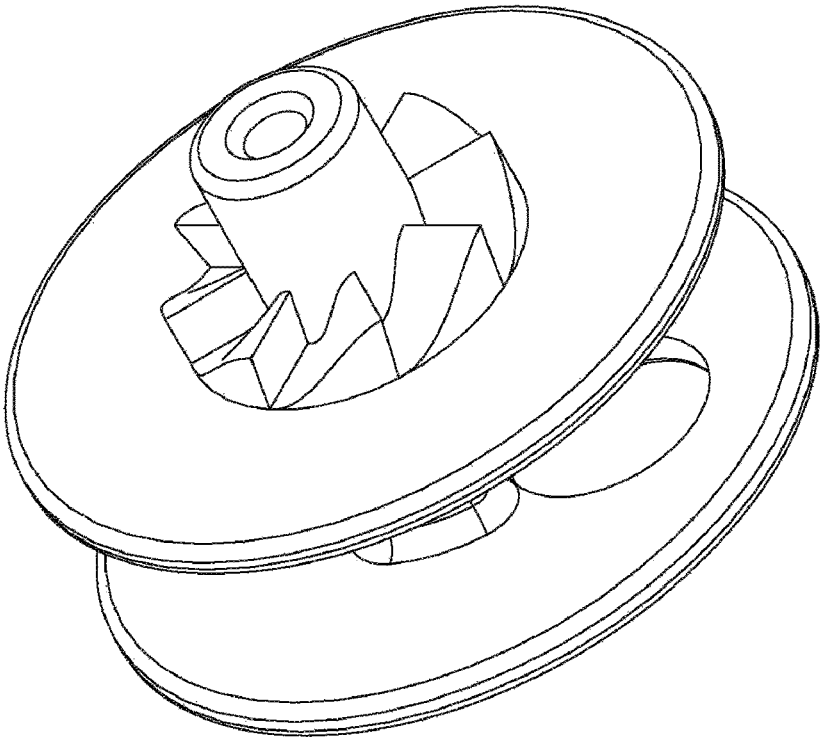
FIG. 16 is a perspective view of the thread reel in the shoelace tightening and releasing device of the present disclosure.
Figure 17:
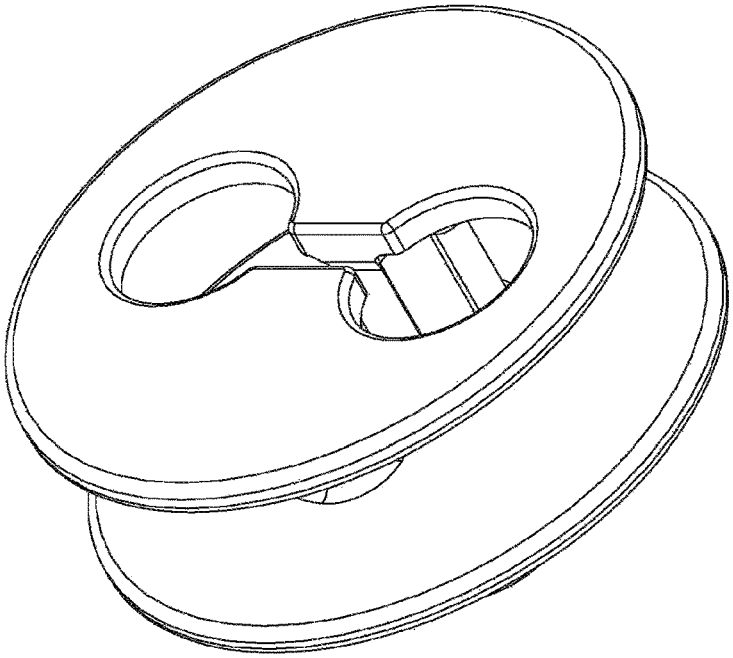
FIG. 17 is a perspective view of the thread reel in the shoelace tightening and releasing device of the present disclosure.
Figure 18:
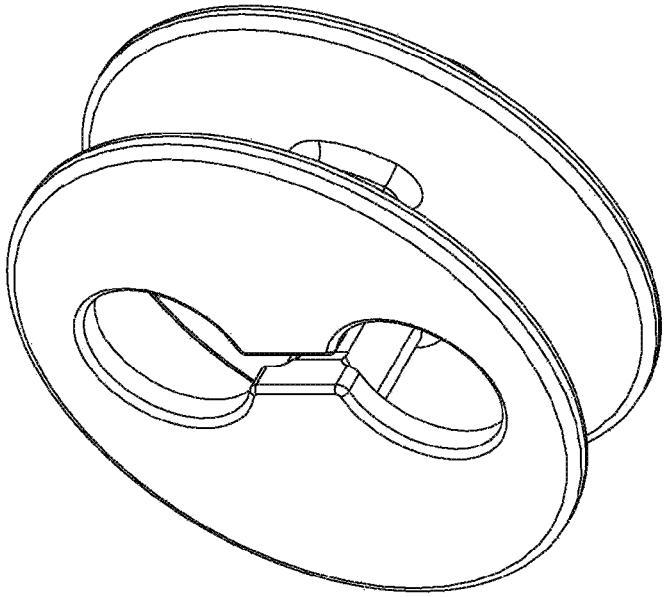
FIG. 18 is a perspective view of the thread reel in the shoelace tightening and releasing device of the present disclosure.
Figure 19:
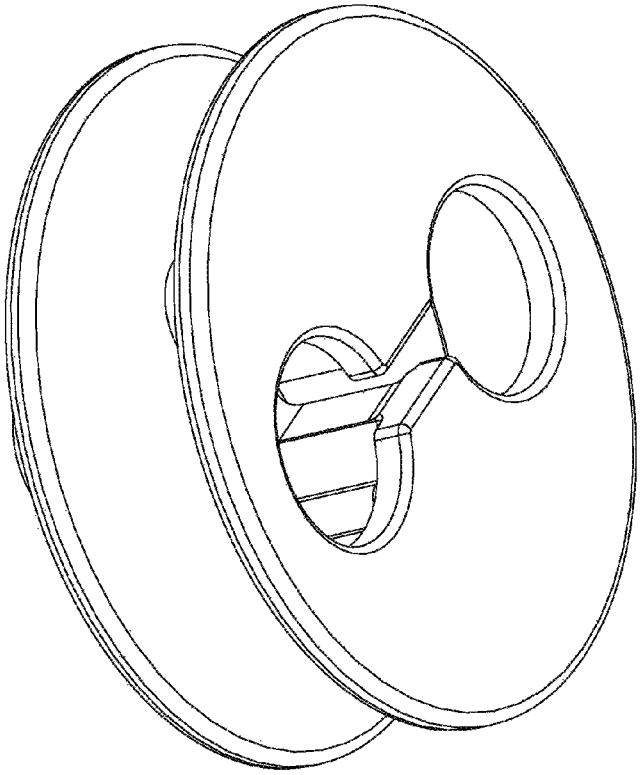
FIG. 19 is a perspective view of the thread reel in the shoelace tightening and releasing device of the present disclosure.

Referring to FIG. 1 to FIG. 11, the present disclosure provides a shoelace tightening and releasing device 1, comprising:

a thread reel 11 configured to allow a thread to wind thereon, a knob device 12 in transmission connection with the thread reel 11, and a position-limiting device 13 and an arresting disk 14 arranged between the thread reel 11 and the knob device 12; referring to FIG. 2, FIG. 3, FIG. 6, FIG. 7, and FIG. 12 to FIG. 19;

a first master linkage component 121 is disposed on a side of the knob device 12 that faces the thread reel 11; and a first slave linkage component 1112 meshed with the first master linkage component 121 is disposed on a side of the thread reel 11 that faces the knob device 12;

the arresting disk 14 is provided with a master arresting component 141; and the knob device 12 is provided with a slave arresting component 122 that is meshed with the master arresting component 141;

the position-limiting device 13 is provided with a master position-limiting component 131; and the knob device 12 is provided with a slave position-limiting component 123 that is engaged with the master position-limiting component 131;

after the knob device 12 is pressed, both the thread reel 11 and the arresting disk 14 are locked relative to the knob device 12, the arresting disk 14 restricts a clockwise or counterclockwise rotation of the knob device 12, and the knob device 12 drives the thread reel 11 to rotate so as to tighten the shoelace;

when the knob device 12 is pulled up, both the thread reel 11 and the arresting disk 14 are unlocked from the knob device 12, and the thread reel 11 releases the shoelace, and at the same time, the position-limiting device 13 restricts the detachment of the knob device 12.

As described above, compared with the prior art, the shoelace tightening and releasing device 1 according to the present disclosure comprises: a thread reel 11 configured to allow a thread to wind thereon, a knob device 12 in transmission connection with the thread reel 11, and a position-limiting device 13 and an arresting disk 14 arranged between the thread reel 11 and the knob device 12; after the knob device 12 is pressed, a slave position-limiting component 123 on a first master linkage component 121 of the knob device 12 is staggered relative to a master position-limiting component 131 on the position-limiting device 13, and at the same time, both the thread reel 11 and the arresting disk 14 are locked relative to the knob device 12, and the arresting disk 14 restricts the clockwise or counterclockwise rotation of the knob device 12 so that the rotating device can be rotated only clockwise or counterclockwise, and of course, the thread reel 11 locked relative thereto rotates in a direction coinciding with the rotating direction of the rotating device and cannot rotate in the reverse direction. The knob device 12 drives the thread reel 11 to rotate so as to tighten the shoelace.

When the knob device 12 is pulled up, the slave position-limiting component 123 on the first master linkage component 121 of the knob device 12 is staggered relative to the master position-limiting component 131 on the position-limiting device 13 again, both the thread reel 11 and the arresting disk 14 are unlocked from the knob device 12, the thread reel 11 releases the shoelace, and at the same time the position-limiting device 13 restricts the detachment of the knob device 12.

In some embodiments of the present disclosure, referring to FIG. 2, FIG. 3, FIG. 6, FIG. 7, and FIG. 12 to FIG. 19, the thread reel 11 comprises a winding spindle 111, a top disk 112, and a bottom disk 113 arranged at a bottom of the winding spindle 111; the bottom disk 113 is provided with a bottom through hole 1131 allowing the shoelace to pass therethrough; the winding spindle 111 is provided with a spindle hole 1111 communicating with the bottom through hole 1131; and the first slave linkage component 1112 is disposed at an end of the winding spindle 111 that faces the position-limiting device 13.

In some embodiments of the present disclosure, the position-limiting device 13 is provided with a receiving cavity 132 for receiving the thread reel 11; and the receiving cavity 132 is provided with a position-limiting hole 1321 allowing the winding spindle 111 to pass therethrough.

In some embodiments of the present disclosure, the master position-limiting component 131 is provided with a position-limiting hole 1321; the master position-limiting component 131 is disposed on an inner peripheral side of the position-limiting hole 1321; and the slave position-limiting component 123 is a lug disposed on an outer peripheral side of the first master linkage component 121.

In some embodiments of the present disclosure, the slave arresting component 122 is a ratchet disposed protrudingly on a side of the knob device 12 that faces the arresting disk 14; the master arresting component 141 is a pawl 143; the arresting disk 14 is provided with an arresting hole 142 allowing the first master linkage component 121 to pass therethrough; and after the arresting disk 14 is locked relative to the knob device 12, the pawl 143 is meshed with the ratchet.

In some embodiments of the present disclosure, the pawl 143 is a pawl 143 provided with a V-shaped opening.

In some embodiments of the present disclosure, a base 15 sleeved on the bottom of the position-limiting component is further included; the base 15 is provided with a first threading hole 151; and a second threading hole 135 is formed in a side of the bottom of the position-limiting device 13.

In some embodiments of the present disclosure, a position-limiting buckle 152 is disposed on an inner peripheral side of the base 15; and a bump 133 interlocked with the position-limiting buckle 152 is disposed on an outer peripheral side of the position-limiting device 13.

In some embodiments of the present disclosure, an engagement buckle 134 configured to restrict the detachment of the arresting disk 14 is further disposed protrudingly on a peripheral side of the position-limiting hole 1321; and an outer diameter of the arresting disk 14 is not less than an inner diameter of the position-limiting device 13.

In some embodiments of the present disclosure, a number of claws disposed in a triangular shape are provided on a side of the first master linkage component 121 that faces the arresting disk 14.

The above description is merely illustrative of preferred embodiments of the present disclosure and is not intended to limit the present disclosure. It would be understood by those skilled in the art that various modifications and variations can be made to the present disclosure. Any modifications, equivalent alternatives, improvements and so on made within the spirit and principle of the present disclosure are to be included in the scope of protection of the present disclosure.

The invention claimed is:

1. A shoelace tightening and releasing device, comprising:

a thread reel configured to allow a thread to wind thereon, a knob device in transmission connection with the thread reel, and a position-limiting device and an arresting disk arranged between the thread reel and the knob device, wherein a first master linkage component is disposed on a side of the knob device that faces the thread reel; and a first slave linkage component meshed with the first master linkage component is disposed on a side of the thread reel that faces the knob device;

the arresting disk is provided with a master arresting component; and the knob device is provided with a slave arresting component that is meshed with the master arresting component;

the position-limiting device is provided with a master position-limiting component;

and the knob device is provided with a slave position-limiting component that is engaged with the master position-limiting component;

after the knob device is pressed, both the thread reel and the arresting disk are locked relative to the knob device, the arresting disk restricts a clockwise or counterclockwise rotation of the knob device, and the knob device drives the thread reel to rotate so as to tighten the shoelace;

when the knob device is pulled up, both the thread reel and the arresting disk are unlocked from the knob device, and the thread reel releases the shoelace, and at the same time, the position-limiting device restricts a detachment of the knob device, wherein the thread reel comprises a winding spindle, a top disk, and a bottom disk arranged at a bottom of the winding spindle; the bottom disk is provided with a bottom through hole allowing the shoelace to pass therethrough; the winding spindle is provided with a spindle hole communicating with the bottom through hole; and the first slave linkage component is disposed at an end of the winding spindle that faces the position-limiting device.

2. The shoelace tightening and releasing device according to claim 1, wherein the position-limiting device is provided with a receiving cavity for receiving the thread reel; and the receiving cavity is provided with a position-limiting hole allowing the winding spindle to pass therethrough.

3. The shoelace tightening and releasing device according to claim 2, wherein the master position-limiting component is provided with the position-limiting hole; the master position-limiting component is disposed on an inner peripheral side of the position-limiting hole; and the slave position-limiting component is a lug disposed on an outer peripheral side of the first master linkage component.

4. The shoelace tightening and releasing device according to claim 3, wherein the slave arresting component is a ratchet disposed protrudingly on a side of the knob device that faces the arresting disk; the master arresting component is a pawl; the arresting disk is provided with an arresting hole allowing the first master linkage component to pass therethrough; and after the arresting disk is locked relative to the knob device, the pawl is meshed with the ratchet.

5. The shoelace tightening and releasing device according to claim 4, wherein the pawl is a pawl provided with a V-shaped opening.

6. The shoelace tightening and releasing device according to claim 5, further comprising a base sleeved on a bottom of the position-limiting component, wherein the base is provided with a first threading hole; and a second threading hole is formed in a side of a bottom of the position-limiting device.

7. The shoelace tightening and releasing device according to claim 6, wherein a position-limiting buckle is disposed on an inner peripheral side of the base; and a bump interlocked with the position-limiting buckle is disposed on an outer peripheral side of the position-limiting device.

8. The shoelace tightening and releasing device according to claim 7, wherein an engagement buckle configured to restrict a detachment of the arresting disk is further disposed protrudingly on a peripheral side of the position-limiting hole; and an outer diameter of the arresting disk is not less than an inner diameter of the position-limiting device.

9. The shoelace tightening and releasing device according to claim 8, wherein a number of claws disposed in a triangular shape are provided on a side of the first master linkage component that faces the arresting disk.

* * * * *